US005387846A

United States Patent [19]

So

[11] Patent Number: 5,387,846

[45] Date of Patent: Feb. 7, 1995

[54] COMBINATION BALLAST FOR DRIVING A FLUORESCENT LAMP OR TUBE AND BALLAST PROTECTION CIRCUIT

[75] Inventor: Gin P. So, Hong Kong, Hong Kong

[73] Assignee: Selwyn Yuen, Ontario, Canada; a part interest

[21] Appl. No.: 931,595

[22] Filed: Aug. 18, 1992

Related U.S. Application Data

[63] Continuation-in-part of Ser. No. 799,209, Nov. 27, 1991, abandoned.

[51] Int. Cl.[6] ..... H05B 37/02

[52] U.S. Cl. ..... 315/209 R; 315/244; 315/225; 315/262; 315/DIG. 7

[58] Field of Search ..... 315/209 R, 228, DIG. 7, 315/244, 225, 362, 219, 221

[56] References Cited

U.S. PATENT DOCUMENTS 4,535,271 8/1985 Holmes ..... 315/209 R 5,065,074 11/1991 Hesketh et al. ..... 315/209 R

*Primary Examiner*—Robert J. Pascal

*Assistant Examiner*—Reginald A. Ratliff

*Attorney, Agent, or Firm*—Hawes & Fischer

[57] ABSTRACT

A circuit is disclosed to implement an energy saving electronic ballast (1A) for driving a fluorescent lamp or tube (2). The circuit is characterized by a high power factor, low harmonic distortion and minimized radio frequency interference. The circuit includes a unique DC power supply (4) comprising a high pass filter (8), which receives an AC input signal, a diode bridge rectifier (6) and a high speed diode rectifier (D2) which cooperates with the bridge rectifier to provide the power supply with first and second rectification stages. A current regulating capacitor (C4) for driving the fluorescent lamp or tube is connected to the DC power supply between the first and second rectification stages. A trigger and high frequency oscillator are provided after the second rectification stage of the power supply to provide the DC current necessary to operate the ballast circuit. A protection circuit (30) is connected to the ballast and operable to disable the oscillator and thereby prevent damage to the ballast in the event that the tube or lamp is defective or disconnected from the ballast or subjected to abnormal operating conditions.

20 Claims, 3 Drawing Sheets

COMBINATION BALLAST FOR DRIVING A FLUORESCENT LAMP OR TUBE AND BALLAST PROTECTION CIRCUIT

CROSS-REFERENCES TO RELATED PATENT APPLICATIONS

This patent application is a continuation-in-part of patent application Ser. No. 07/799,209 filed Nov. 27, 1991, now abandoned.

BACKGROUND OF THE INVENTION

1. Field of the Invention

This invention relates to a compact, relatively low cost, energy-saving electronic ballast that is particularly useful for efficiently driving a fluorescent tube or a compact fluorescent lamp. The ballast is characterized by a high power factor, low total harmonic distortion and minimal radio frequency interference and is adapted to be used with compatible tubes and lamps from different manufacturing sources. A protection circuit is connected to the ballast to prevent damage thereto in the event that the tube or lamp is defective or disconnected from the ballast or subjected to abnormal operating conditions.

2. Background Art

Fluorescent tube and compact fluorescent lamp assemblies are well known lighting devices. The fluorescent tube assembly includes a tube and a separate electronic ballast or adapter to drive the tube. In the case of the compact fluorescent lamp assembly, a lamp and ballast are combined as an integrated unit.

The conventional ballast that is associated with the fluorescent tube assembly is typically heavy and large. Moreover, such a ballast is not very energy efficient and is characterized by a low power factor. The conventional ballast associated with the compact fluorescent lamp assembly is also characterized by a low power factor, unless size is sacrificed. Such a ballast is also characterized by total harmonic distortion which, in many cases, is not in full compliance with government regulations. Because the compact lamp and electronic ballast are integrated, the entire lighting assembly must be discarded when the lamp is damaged or reaches the end of its life. The foregoing results in waste and inefficient use of materials, particularly in view of the fact that the ballast is more costly to manufacture than the lamp and commonly has a longer expected life span.

Ballasts are also known to fail because of certain failures in the fluorescent tube or lamp. Consequently, the life of the ballast is reduced and the frequency of replacement is increased, whereby operating costs are correspondingly increased. Such failures to the ballast may occur if power is applied when the tube (i.e. load) is removed from the ballast or when an incorrect or defective tube is connected to the ballast or the tube is subjected to either a transient voltage surge or a high ambient temperature that alters the electrical characteristics thereof.

It would therefore be desirable to overcome the aforementioned shortcomings to fluorescent lighting devices by providing a lightweight, compact, energy efficient electronic ballast that would have low total harmonic distortion, minimum radio frequency interference, and a high power factor (e.g. 0.9 or higher). Moreover, it would be desirable that the ballast be detachable from the fluorescent lamp so that the lamp can be replaced without the necessity of scrapping the ballast. In addition, the ballast must comply with all government regulations and be compatible with fluorescent tubes and lamps that are produced by different manufacturers. Furthermore, it would be desirable to have a protection circuit connected to the ballast to reduce failures thereof as a consequence of certain failures in the tube or lamp.

SUMMARY OF THE INVENTION

In general terms, a circuit is disclosed for implementing a relatively low cost, lightweight, energy efficient ballast for driving a fluorescent tube or compact lamp. In accordance with a first embodiment of the present invention, the ballast includes a unique DC power supply comprising a high pass filter and a pair of diode rectifiers, such that the input current is first filtered and then twice rectified to provide the DC current required to operate the ballast circuit. The ballast also includes a high frequency oscillator and power output section comprising the interconnection of a ferrite oscillator transformer, first and second power transistors arranged in a push-pull relationship, a ferrite choke coil, capacitors and resistors. Also included is a section to trigger the oscillator and thereby cause the fluorescent tube/lamp to ignite. The trigger section will become inactive once the tube/lamp has ignited.

In accordance with a second embodiment of the present invention, a protection circuit is connected to the ballast to avoid failure of the ballast due to certain failures to the fluorescent tube or lamp. The protection circuit includes a ferrite choke coil which is responsive to the output power of the ballast, a transistor switch that operates to terminate the ability of the ballast to oscillate and sustain damage during a failure of the fluorescent tube, and a flip-flop circuit connected between the choke coil and the transistor switch to control the operation of said switch in response to the power sensed by said coil. Under normal operating conditions, the flip-flop is disabled, the switch is non-conductive and the ballast oscillates in the usual fashion for driving the tube. Under no load conditions, where the tube is damaged or disconnected from the ballast, the flip-flop is enabled, the switch becomes conductive and the oscillation of the ballast is terminated.

DETAILED DESCRIPTION

Figure 1:
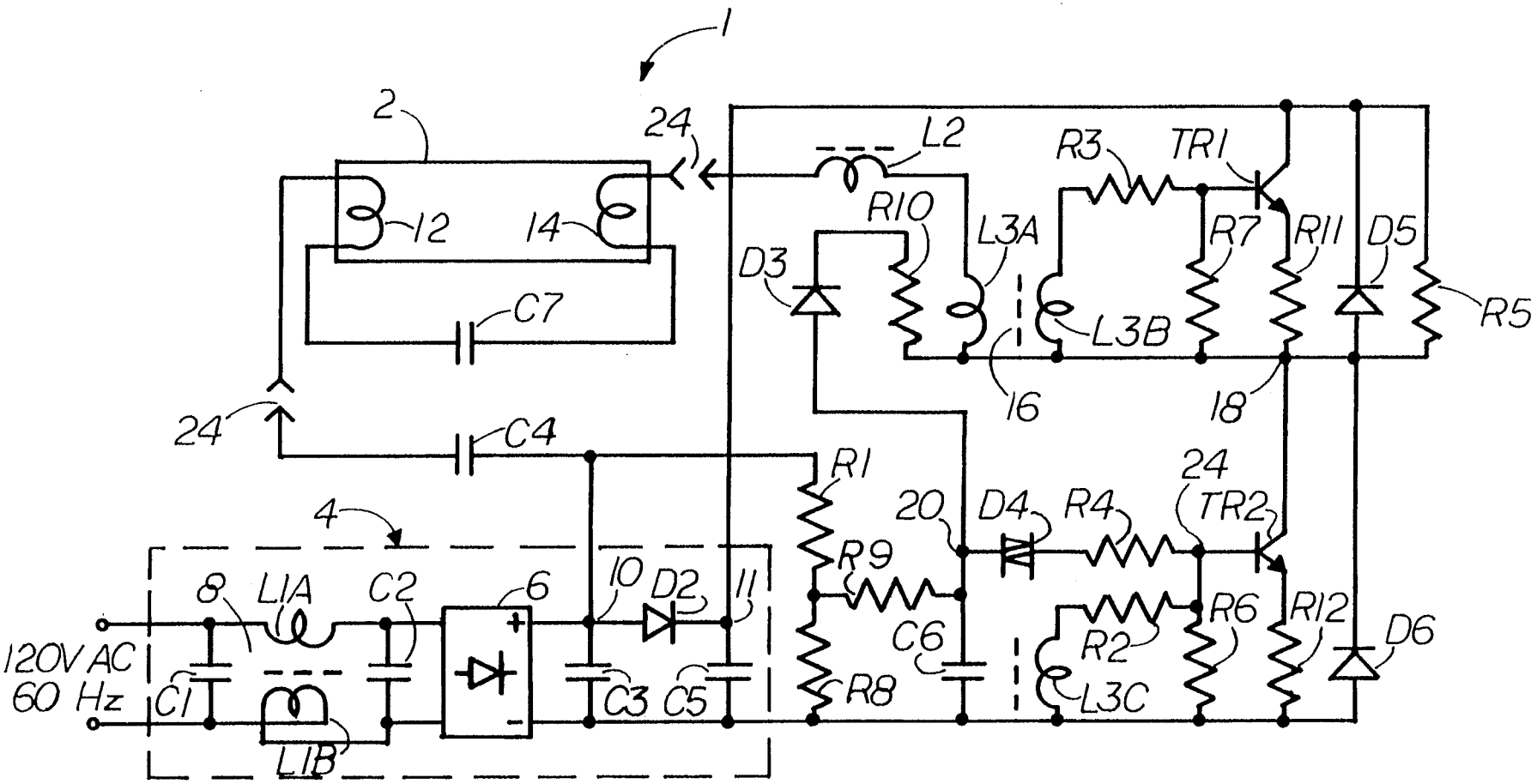
FIG. 1 shows a circuit having a unique DC power supply for implementing the electronic ballast of the present invention for efficiently driving a fluorescent tube or lamp.

An electronic circuit 1 for implementing a relatively compact, lightweight, low cost, and energy efficient ballast which forms the present invention and which may be detachably connected to a fluorescent tube 2 is initially described while referring to FIG. 1 of the drawings. While a tube 2 is shown and described, it is to be expressly understood that the ballast circuit I may also be used with a compact fluorescent lamp. The ballast circuit 1 includes a unique DC power supply 4 that is connected to receive a 120 volt AC, 60 Hz input line signal. The power supply 4 includes a pair of filter capacitors C1 and C2 that are connected in parallel with one another. Connected between filter capacitors C1 and C2 are a pair of ferrite choke coils L1A and L1B. Capacitors C1 and C2 and ferrite choke coils L1A and L1B are interconnected to form a high pass filter 8. Note the reverse connection of ferrite choke coil L1B relative to coil L1A of filter 8 which contributes to producing a high power factor. The high pass filter 8 will advantageously limit the radio frequency interference produced by the AC input signal so as to comply with government regulations regarding such interference without consuming large amounts of power. Filter 8 is connected to a conventional diode bridge rectifier 6 by which to provide half wave rectification of the filtered AC input signal in the usual manner.

The DC power supply 4 includes a pair of rectification stage output capacitors C3 and C5 that are connected in parallel with one another and the diode bridge rectifier 6. A high speed rectifier diode D2 is connected between output capacitors C3 and C5. The capacitance of output capacitor C5 is preferably very large relative to the capacitance of output capacitors C3 to achieve a high power factor, as will soon be described. By way of example only, the optimum values of the circuit components which form the DC power supply 4 of ballast circuit 1 are given as follows:

C1=0.1 to 0.22 μF
C2=0.005 to 0.01 μF
C3=0.005 to 0.01 μF
C5=22 to 33 μF
L1A=0.01 to 0.015 Henries
L1B=0.01 to 0.015 Henries A first rectification stage output terminal 10 of power supply 4 is formed at a common electrical junction with rectifier 6, diode D2, output capacitor C3, a current regulating capacitor C4 and a resistor R1. Current regulating capacitor C4 is connected in series with the electrodes 12 and 14 of fluorescent tube 2 by way of a capacitor C7 which is connected between said electrodes 12 and 14. Capacitor C7 may be either an integral part of the fluorescent tube 2 (as shown) or part of the ballast circuit 1. Electrode 14 is also connected in series with a ferrite choke coil L2 and a coil L3A which forms a ferrite oscillator transformer 16. A second coil L3B of transformer 16 is connected to the base of a first power transistor TR1 via a current limiting resistor R3.

A second rectification stage output terminal 11 of power supply 4 is formed at a common electrical junction with rectifier diode D2, output capacitor C5 and the collector of transistor TR1. The diode bridge 6 and high speed diode D2 provide power supply 4 with double rectification to provide the circuit 1 with DC power necessary to obtain a high power factor. More particularly, the first rectification stage output terminal 10 functions as a current summing junction, such that diode D2 rectifies the input current rectified by diode bridge 6 and current from the tube 2 which passes through current regulating capacitor C4. Accordingly, all of the DC current necessary for operating the remainder of ballast circuit 1 is available from the second rectification stage output terminal 11.

The emitter of transistor TR1 is connected to a common electrical junction 18 with coils L3A and L3B of the ferrite oscillator transformer 16 and a resistor R7 via a resistor R11. Resistor R11 is connected in a feedback path with resistor R7 between the emitter and base of transistor TR1.

The collector of a second power transistor TR2 is also connected to common electrical junction 18. The emitter of transistor TR2 is connected to ground via a resistor 12. Resistor R12 is connected in a feedback path with a resistor R6 between the emitter and base of transistor TR2. The base of transistor TR2 is connected to a common electrical junction 20 by way of a current limiting resistor R4 and a diac D4. A coil L3C which is magnetically coupled to the coils L3A and L3B to provide reactance to the ferrite oscillator transformer 16, is connected through a resistor R2 to a common electrical junction 24 formed with resistors R4 and R6 and the base of transistor TR2.

With fluorescent tube 2 connected to ballast circuit 1, the interconnection of power transistors TR1 and TR2, ferrite choke coil L2, ferrite transformer coils L3A, L3B and L3C, capacitors C3 and C4 and rectifier diode D2 provides the ballast circuit 1 with high frequency oscillation and high power output for efficiently driving fluorescent tube 2. When tube 2 is removed from circuit 1, the aforementioned high frequency operation will cease.

The aforementioned resistor R1 is connected in series with a resistor R8 to form a voltage divider network. A resistor R9 is connected from the common electrical junction 20 with diac D4 to a point between voltage divider resistors R1 and R8. A capacitor C6 is connected between common electrical junction 20 and ground. As will also be described in greater detail, the interconnection of resistors R1, R4 and R9, diac D4 and capacitor C6 provides the ballast circuit 1 with a trigger capability.

A diode D5 is connected across the interconnection of resistor R11 with the emitter and collector of transistor TR1, and a resistor R5 is connected across the diode D5. Another diode D6 is connected from common electrical junction 18 to ground. Thus, diode D6 is connected across the interconnection of resistor R12 with the emitter and collector of transistor TR2. Diodes D5 and D6 are included to protect power transistors TR1 and TR2 against voltage surges. A diode D3 is connected from the common electrical junction 20 with diac D4, resistor R9 and capacitor C6 to the coil L3A of transformer 16 by way of a resistor R10. Diode D3 and resistor R10 are included to disable the aforementioned trigger after ballast circuit 1 begins its high frequency oscillation.

The operation of the ballast circuit 1 of FIG. 1 is now described. The 60 Hz source or line voltage signal initially passes through the high pass filter 8 of DC power supply 4. The line voltage signal is then rectified at the diode bridge rectifier 6. The half wave rectified 120 Hz signal is regulated by a high frequency current (in the order of tens of kHz) through current regulating capacitor C4 (best illustrated by the waveform of FIG. 4*b*). The majority of the high frequency current from capacitor C4 flows through the first rectification stage output terminal 10 of power supply 4 to output capacitor C5 by way of diode D2 at which said current is rectified. However, a minor portion of the high frequency current through capacitor C4 flows to output capacitor C3 via output terminal 10. Being that the inductance of high pass filter 8 is relatively low, as indicated above, little reactance is provided for the 60 Hz line voltage, but a high resistance is provided to the high frequency current added to the 120 Hz current at output terminal 10 (see FIG. 4*b*).

With regard to the trigger operation of ballast circuit 1, positive current flowing through resistors R1 and R9 will be applied to capacitor C6. When the voltage across capacitor C6 increases to about 30 to 32 volts, the diac D4 will produce a pulsating current flowing through resistor R4 to the base of power transistor TR2 to trigger the oscillator of ballast circuit 1. When the voltage across capacitor C6 drops to about 3 volts, the trigger is disabled.

The current flowing in coil L3A of ferrite oscillator transformer 16 is magnetically coupled to coils L3B and L3C. Thus, with power transistors TR1 and TR2 working in standard push-pull fashion, an oscillator is created which operates in the 40–70 kHz range (depending upon the particular fluorescent tube 2 being used). Being that an oscillator is common to conventional ballast circuits, a detailed description of the operation of the oscillator of ballast circuit 1 will not be described.

Ferrite choke coil L2, which is connected in series with electrode 14 and coil L3A of transformer 16, provides two important functions. Prior to ionization and the ignition of the fluorescent tube 2, ferrite choke coil L2 cooperates with capacitor C7 to provide the high voltage necessary between electrodes 12 and 14 to ionize the gas in tube 2. What is more, after the tube 2 is ignited, ferrite choke coil L2 limits the current, whereby to stabilize the operation of tube 2.

Considering now the formula $R_L=2\pi fL$, where:

RL=the reactance (equivalent resistance) of L f=frequency

L=inductance.

When 2L is known, $R_L$ is directly proportional to f. That is to say, when the frequency increases, reactance also increases, thereby resulting in corresponding changes to the waveform of the input current.

Figure 2A:
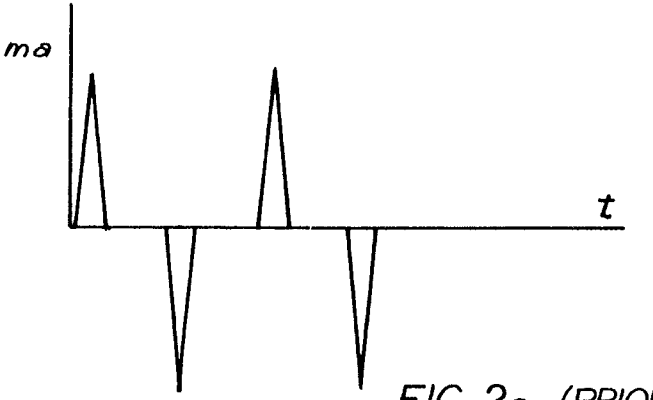
FIG. 2a (PRIOR ART)
FIG. 2*a* illustrates the input current waveform of the DC power supply of a conventional electronic ballast.
Figure 2B:
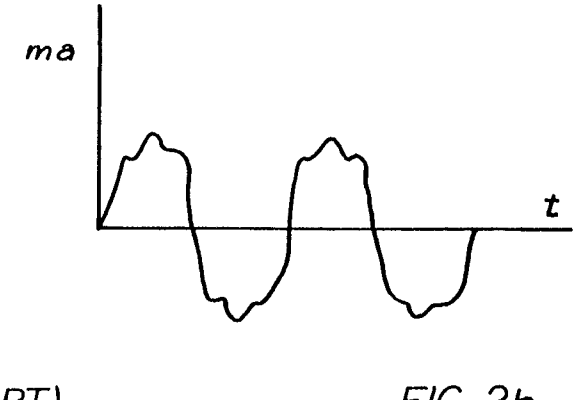
FIG. 2*b* illustrates the input current waveform of the DC power supply of the circuit of FIG. 1 after regulation.
Figure 3A:
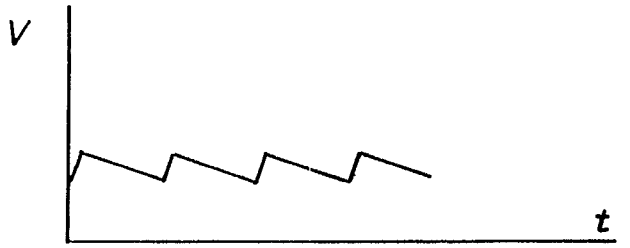
FIG. 3a (PRIOR ART)
FIG. 3*a* illustrates the output voltage waveform of the DC power supply of a conventional electronic ballast.
Figure 3B:
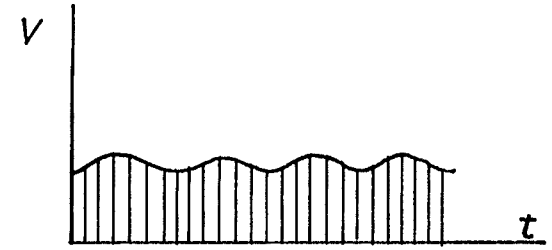
FIG. 3*b* illustrates the output voltage waveform of the DC power supply of the circuit of FIG. 1.
Figure 4A:
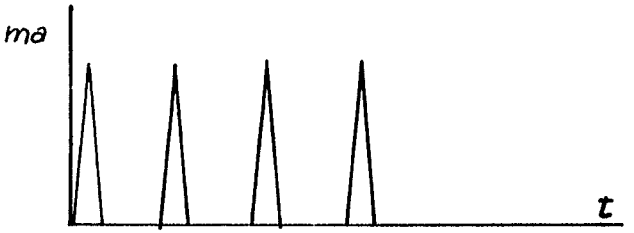
FIG. 4a (PRIOR ART)
FIG. 4*a* illustrates the output current waveform of the DC power supply of a conventional electronic ballast.
Figure 4B:
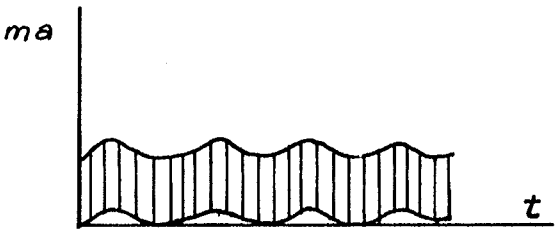
FIG. 4*b* illustrates the output current waveform of the DC power supply of the circuit of FIG. 1 after rectification.

The foregoing is best illustrated while referring to FIGS. 2–4 of the drawings. FIGS. 2*a*, 3*a* and 4*a* show waveforms associated with the DC power supply of a typical electronic ballast, while FIGS. 2*b*, 3*b* and 4*b* show corresponding waveforms associated with the power supply 4 of ballast circuit 1 of FIG. 1. In practice, the time to charge the output capacitor of the power supply of a conventional ballast circuit is very short. Therefore, the waveform of the input current will be pulsating (best illustrated in FIG. 2*a*). Hence, the RMS current is large, the power factor is only about 0.5, and the harmonic content will typically exceed 90%.

In the DC power supply 4 of ballast circuit 1, the 120 Hz half waveform current at output capacitor C3 and the 40 to 70 kHz current produced by the oscillator of ballast circuit 1 regulate each other. Moreover, the high pass filter 8 and diode D2 cause the current applied to output capacitor C5 via second rectification stage output terminal 11 to be very smooth and even (best illustrated in FIG. 4*b*). Thus, and is best shown by comparing FIGS. 2*a* and 2*b*, the RMS of the AC input current is reduced by about 39% or more in the DC power supply 4 of FIG. 1 relative to the RMS of the AC input current to the power supply of the conventional ballast. Changing the pulsating input current waveform shown in FIG. 2*a* to the near sinusoidal input current waveform of FIG. 2*b* greatly reduces the input current harmonics and advantageously raises the power factor from 0.5 to about 0.9, or more.

The following list represents the optimum parameters of other components of ballast circuit 1:

C4=0.01–0.1 μF
C6=0.04–0.068 μF
R1=470 k Ohm
R2=R3=12–18 Ohm
R4=15 Ohm
R5=220 k Ohm
R6=R7=68 Ohm
R8=R9=330 k Ohm
R10=10 k Ohm
R11=R12=0–2.7 Ohm
TR1=TR2=Part No. LSE1305 or equivalent
D2=D3=D5=D6=Part No. FR104 or equivalent
D4=Part No. HT-32 or equivalent The ballast circuit 1 may be detached from the fluorescent tube 2 at suitable plug-in connection terminals 24. Thus, ballast circuit 1 may be reused with a new tube in the event that an old tube is detached therefrom and discarded. The circuit 1 is advantageously of compact design and lightweight and, therefore, adapted to be used in conventional fluorescent lighting assemblies with the tubes or compact lamps which are available from different manufacturers and have a variety of configurations, such as conical, oval, rectangular or cylindrical.

Figure 5:
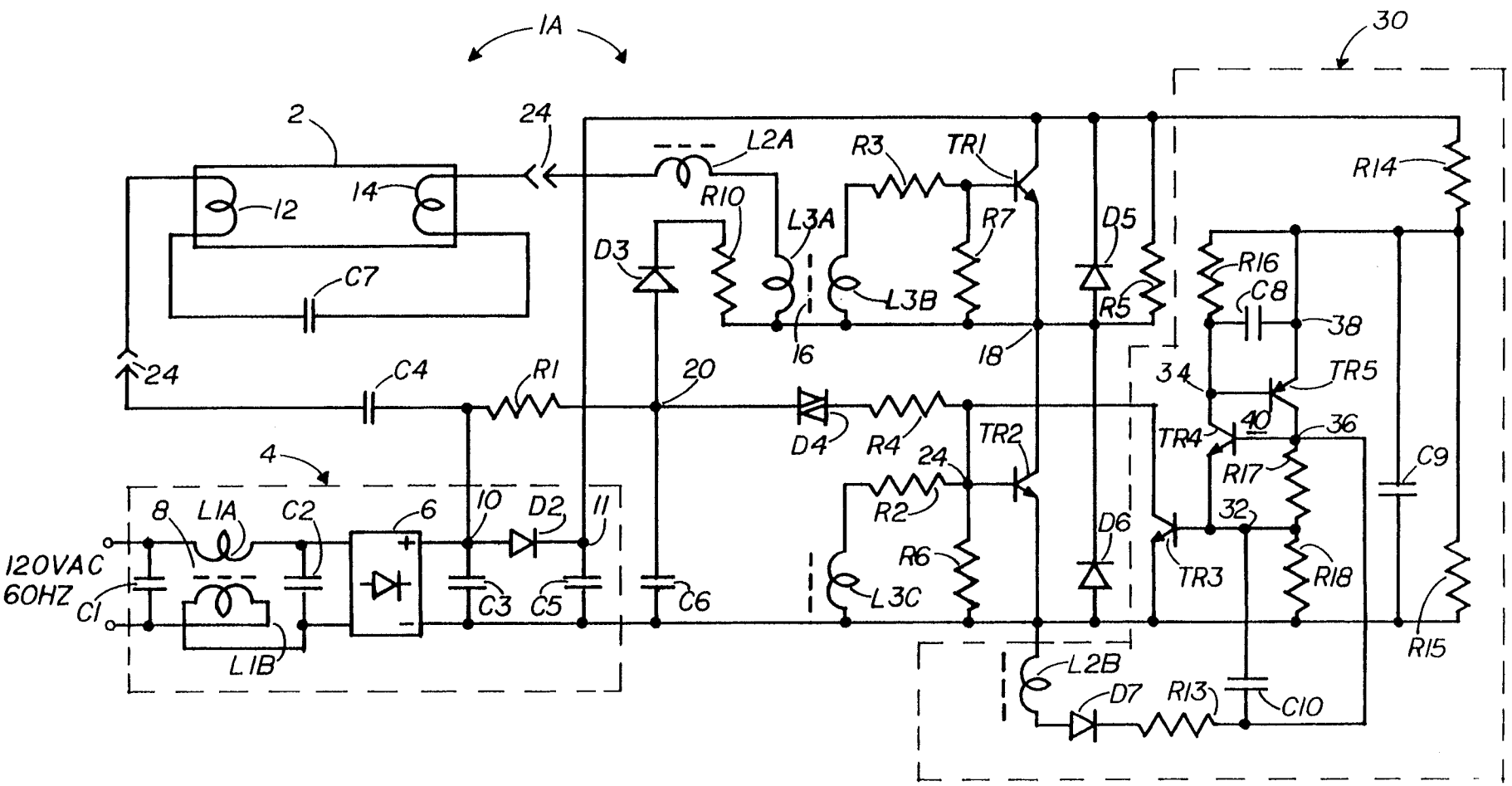
FIG. 5 shows a circuit having an electronic ballast, a fluorescent tube to be driven by the ballast and a protection circuit for enabling the ballast to survive certain failures of the fluorescent tube.

FIG. 5 of the drawings illustrates a protection circuit 30 that is electrically connected to an electronic ballast 1A which drives a fluorescent tube 2. The protection circuit 30 is particularly useful for enabling the ballast 1A to survive certain failures of the fluorescent tube 2 as well as abnormal operating conditions, whereby to increase the operating life of the ballast and correspondingly reduce operating cost by avoiding frequent ballast replacement. Since the circuit for the electronic ballast 1A of FIG. 5 is substantially the same as the circuit for the electronic ballast 1 previously described when referring to FIG. 1, the circuit of ballast 1A will not be described in detail, although like reference numerals have been used to represent identical electrical components.

However, with regard to ballast 1A, it is pointed out that resistors R8 and R9 of ballast 1 have been deleted, and resistor R1 is connected directly to the common electrical junction 20 with diac D4, capacitor C6 and diode D3. Therefore, a circuit path is established between the DC power supply 4, at terminal 10, and the soon to be described protection circuit 30. More particularly, resistor R1 is connected to rectification stage output terminal 10 (or 11) to develop a DC voltage to be supplied to electrical junction 20 to operate capacitor C6 and diode D4.

The protection circuit 30 which is connected to ballast circuit 1A includes three transistors TR3, TR4 and TR5. The collector of transistor TR3 is connected to ballast 1A at the common electrical junction 24 with the base of transistor TR2 and resistors R2, R4 and R6. The emitter of transistor TR3 is connected to the common electrical ground. Thus, the conduction path of transistor TR3 is connected to the aforementioned circuit path from fluorescent tube 2 including capacitor C4, diac D4 and resistors R1 and R4. The base of transistor TR3 is connected at a common electrical junction 32 with one plate of a capacitor C10, each of series connected resistors R17 and R18, and the emitter of transistor TR4.

The collector of transistor TR4 is connected at a common electrical junction 34 with a resistor R16, one plate of a capacitor C8, and the base of transistor TR5. The base of transistor TR4 is connected at a common electrical junction 36 with resistors R13 and R17, the second plate of capacitor C10 and the collector of transistor TR5. The emitter of transistor TR5 is connected at a common electrical junction 38 with the second plate of capacitor C8. The protection circuit 30 is connected from common electrical junction 38, via a resistor R14, to the output terminal 11 of the DC power supply of ballast 1A which was disclosed when referring to FIG. 1.

Thus, a circuit path is established in protection circuit 30 from electrical junction 38 to electrical ground via the conduction path of transistor TR5 and the series connected resistors R17 and R18. A capacitor C9 is connected across the aforementioned circuit path from electrical junction 38 to ground, and a resistor R15 is connected in parallel with capacitor C9.

Protection circuit 30 also includes a ferrite choke coil L2B which is magnetically coupled to the ferrite choke coil L2A of ballast 1A to work together in a fashion similar to a magnetic transformer. The aforementioned resistor R13 is connected from the common electrical junction 36 to electrical ground via a diode D7 and the choke coil L2B.

The operation of the protection circuit 30 in combination with a replaceable fluorescent tube 2 and the ballast circuit 1A is now disclosed. The circuit 30 is adapted to provide protection to ballast 1A under the following operating conditions: (1) the fluorescent tube is removed from ballast 1A (i.e. eliminating the load); (2) the tube is damaged, the incorrect tube is connected, or the tube is subjected to a transient voltage surge; and (3) the tube is subjected to a high ambient temperature effecting the electrical characteristics thereof. Some of the aforementioned conditions would occur if the respective filament electrodes 12 and 14 of the tube 2 are shorted, the tube has no filament electrode, or the tube receives no filament current, such as where both the electrodes 12 and 14 function as anodes.

As important features of the present invention, transistors TR4 and TR5 are coupled to one another in the manner previously described such that said transistors TR4 and TR5 and resistors R16, R17 and R18 form a flip-flop circuit 40. The output power of the ballast 1A is sensed by ferrite coil L2B, diode D7, resistor R13 and capacitor C10. Transistor TR3 is selected to have a low saturation voltage and functions as an ON/OFF switch to control the oscillation and power output of the ballast 1A, depending upon the condition of the tube 2 to be driven thereby.

Under normal operating conditions, when a suitable fluorescent tube 2 is connected to ballast 1A, said tube is the load of the ballast. At this time, and depending upon the characteristics of tube 2, the voltage of capacitor C7, which is connected in series with electrodes 12 and 14, is about 35 to 80 volts, and the current through series connected ferrite choke coil L2A is about 200–350 milliamps whereby to ignite the tube 2. Due to its inductive coupling to coil L2A, a corresponding current is induced in the ferrite choke coil L2B of protection circuit 30, which current is half wave rectified by diode D7. This half wave rectified current passes through resistor R13 and capacitor C10 which smoothes the waveform and produces a potential of about 0.15 to 0.30 volts DC between common electrical junction 36 and electrical ground. The voltage at electrical junction 36 (i.e. at the base of transistor TR4) is insufficient to trigger transistor TR4, whereby the flip-flop 40 comprising transistors TR4 and TR5 is disabled and the protection circuit 30 rendered ineffective.

In the case where the fluorescent tube 2 is either damaged or disconnected from ballast 1A, the effective load of the ballast is removed. Therefore, the voltage between electrodes 12 and 14 will be increased to a few hundred volts. Moreover, current which may be as high as 500 to 1500 milliamps (depending upon the configuration of coil L2A) passes through capacitor C7 and coil L2A without igniting the tube. Due to its coupling to coil L2A, a corresponding current is induced in ferrite choke coil L2B which passes through diode D7, resistor R13 and capacitor C10. Thus, the voltage at common electrical junction 36 is increased so as to trigger transistor TR4 and thereby enable the flip-flop 40. Accordingly, DC current flows through resistors R14 and R16, the collector/emitter conduction path of transistor TR4, to the base of trigger transistor TR3, whereby transistor TR3 is rendered conductive. Because of the low saturation voltage requirement of transistor TR3, when said transistor TR3 is conductive, the peak voltage between common electrical junction 24 (at the base of transistor TR2 of ballast 1A) and electrical ground will be held below 0.4 volts which will cause transistor TR2 to become disabled. Thus, the trigger transistor TR3 functions as a protection switch to selectively disable ballast 1A. That is to say, the push-pull operation of ballast transistors TR1 and TR2 ceases, the ability of ballast 1A to oscillate is thereby terminated and the ballast 1A is advantageously protected against damage and the need for replacement.

In the case where either the wrong fluorescent tube is connected to ballast 1A, or the ballast is subjected to a voltage surge from the power supply, or an ambient temperature increase changes the operating characteristics of the tube, the current passing through magnetically coupled coils L2A and L2B increases and, in the manner described immediately above, the flip-flop 40 is enabled, trigger transistor TR3 is rendered conductive, the push-pull operation of transistors TR1 and TR2 ceases, and the ballast 1A is advantageously protected.

After the problem which caused the protection circuit 30 to be activated has been resolved or a new fluorescent tube has been suitably connected to ballast 1A, choke coils L2A and L2B have no current, the flip-flop 40 is disabled, trigger transistor TR3 becomes non-conductive, and the protection circuit is switched off. The protection circuit 30 will be reset in about 10–25 seconds after the AC input power has been manually switched off and then on. The ballast 1A and tube 2 will then begin to operate normally, such that protection circuit 30 once again becomes ineffective until a new abnormality is detected.

By way of example only, the optimum values of the circuit components which form the protection circuit 30 are given as follows:

R13=R14=120 k–240 k ohm

R15=20 k–39 k ohm

R17=20 k-68 k ohm
TR3=TR4=NPN transistor
TR5=PNP transistor
D7=switching diode
C8=C9=0.047 μF-0.22 μF
C10=22 μF-100 μF
L2A=0.001-0.006 Henries
L2B=2-5 turns It may be appreciated that where the fluorescent tube 2 develops a short circuit between electrodes 12 and 14, no current will flow. However, because of current regulating capacitor C7 connected in series with electrodes 12 and 14 and ferrite choke coil L2A connected to an output terminal of the ballast 1A at electrode 24, a high voltage (e.g. as high as 1000 volts) will be created to thereby ionize the gas within the tube 2, allow current to flow and light to be generated. Accordingly, the temperature inside the tube is heated and, consequently, the resistence is reduced. Once this resistance is sufficiently reduced, the tube operating voltage will also be reduced to normal. Unlike conventional ballasts, the foregoing enables the ballast 1A to start tube 2 when the filament electrodes are shorted or missing.

It will be apparent that-while a preferred embodiment of the invention has been shown and described, various modifications and changes may be made without departing from the true spirit and scope of the invention.

Having thus set forth the preferred invention, what is claimed is:

1. An electronic ballast having an output terminal at which to provide output power for driving a fluorescent lamp or tube, said ballast comprising:

power supply means;

oscillator means connected between said power supply means and the lamp or tube to provide a high frequency output signal to said lamp or tube; and a protection circuit including a protection switch connected to said oscillator means to control the operation thereof and a flip-flop connected to said protection switch and responsive to the output power of said ballast, said flip-flop being triggered to operate said protection switch for terminating the operation of said oscillator means and disabling said ballast when the lamp or tube is defective or disconnected from said ballast and the output power of said ballast undergoes a corresponding change.

2. The electronic ballast recited in claim 1, wherein said oscillator means includes a pair of power transistors arranged in a push-pull relationship with one another, the protection switch of said protection circuit connected to the control terminal of one of said transistors to control the operation of said one transistor and the oscillation of said oscillator means.

3. The electronic ballast recited in claim 1, wherein said protection circuit also includes a first ferrite choke coil to sense the output power of said ballast and provide a corresponding signal to said flip-flop to thereby trigger said flip-flop when said output power passes a threshold level.

4. The electronic ballast recited in claim 3, said ballast further comprising a second ferrite choke coil magnetically coupled to said first ferrite choke coil of said protection circuit, said second choke coil connected to the output terminal of said ballast and inducing a current in said first choke coil for triggering said flip-flop and thereby terminating the operation of said oscillator means when the output power of said ballast at said output terminal passes said threshold level.

5. The electronic ballast recited in claim 4, wherein said first and second ferrite choke coils form a ferrite transformer.

6. The electronic ballast recited in claim 3, wherein said protection circuit also includes a diode connected to said first ferrite choke coil, a resistor connected to said diode, and a capacitor connected to said resistor by which to provide said signal from said choke coil to said flip-flop in response to the output power of said ballast, said signal causing said flip-flop to trigger and the operation of said oscillator means to terminate when said output power passes said threshold level.

7. The electronic ballast recited in claim 1, wherein said protection switch of said protection circuit is a transistor having a control electrode and a plurality of conduction path electrodes, the control electrode of said transistor connected to said flip-flop and one of said conduction path electrodes connected to said oscillator means.

8. An electronic ballast to provide output power for driving a fluorescent lamp or tube, said ballast comprising:

power supply means;

oscillator means connected between said power supply means and the lamp or tube to provide a high frequency output signal to said lamp or tube; and a protection circuit including a first ferrite choke coil that is responsive to the output power of said ballast and a flip-flop interconnected between said oscillator means and said first ferrite choke coil to receive from said choke coil a signal corresponding to the output power of said ballast, said flip-flop adapted to terminate the operation of said oscillator means and thereby disable said ballast when the lamp or tube is defective or disconnected from said ballast and the power to which said choke coil is responsive passes a threshold level.

9. The ballast recited in claim 8, further comprising a second ferrite choke coil magnetically coupled to said first ferrite choke coil of said protection circuit, said second choke coil sensing the output power of said lamp or tube and inducing a current in said first choke coil for controlling the operation of said flip-flop depending upon the output power of said ballast.

10. The ballast recited in claim 9, wherein said first and second ferrite choke coils form a ferrite transformer.

11. The ballast recited in claim 8, said protection circuit also including a diode connected to said first ferrite choke coil, a resistor connected to said diode, and a capacitor connected between said resistor and said flip-flop, said capacitor producing a signal to be supplied to said flip-flop which is dependent upon the output power to which said first choke coil is responsive for controlling the operation of said flip-flop.

12. The ballast recited in claim 8, wherein the flip-flop of said protection circuit includes a pair of transistors that are cross-coupled to one another such that the control electrode of one transistor is connected to a conduction path electrode of the other transistor and vice versa.

13. The ballast recited in claim 8, said protection circuit also including a protection switch connected to said oscillator means to control the operation thereof, said flip-flop being triggered when the output power to which said first ferrite choke coil is responsive passes said threshold level to close said protection switch and terminate the operation of said oscillator means, whereby to disable said ballast.

14. The combination of an electronic ballast to drive a fluorescent lamp or tube and a protection circuit to disable said ballast when the lamp or tube is defective or disconnected from said ballast, said ballast including a DC power supply to receive an AC input signal and provide an output signal to ignite the lamp or tube and oscillator means connected between said power supply and said lamp or tube to provide a high frequency output signal to said lamp or tube, the DC power supply of said ballast comprising:

filter means to filter the AC input signal;

first rectification means to rectify the filtered AC input signal;

second rectification means connected to said first rectification means so that said input signal is rectified twice; and an output terminal connected to said second rectification means to provide a DC output current for operating said ballast, said ballast further including current regulating means regulating the filtered AC input signal rectified by said first rectification means and including a first capacitor connected between an electrode of the fluorescent lamp or tube and a point between the first and second rectification means of said DC power supply, such that a high frequency current flows from said lamp or tube to said second rectification means by way of said current regulating capacitor, and said protection circuit including switching means connected to said oscillator means and responsive to the output power of said ballast, said switching means being triggered when the output power of said ballast passes a threshold level to terminate the operation of said oscillator means and thereby disable said ballast.

15. The combination recited in claim 14, wherein the switching means of said protection circuit includes a flip-flop.

16. The combination recited in claim 14, wherein said first rectification means of said DC power supply of said ballast is a diode bridge.

17. The combination recited in claim 14, wherein said second rectification means of said DC power supply of said ballast is a diode.

18. The combination recited in claim 14, wherein the filter means of said DC power supply of said ballast is a high pass filter including a pair of ferrite choke coils, one of said coils being reverse connected relative to the other coil.

19. The combination recited in claim 14, wherein said DC power supply of said ballast further comprises a second capacitor connected across said first rectification means and a third capacitor connected in parallel with said first capacitor, said second rectification means of said DC power supply being connected between said second and third capacitors.

20. The combination recited in claim 14, wherein said oscillator means of said ballast includes a ferrite transformer comprising a plurality of ferrite choke coils which are magnetically coupled to One another, said ferrite transformer sensing the output power of said ballast and providing a corresponding signal to the switching means of said protection circuit to trigger said switching means and thereby terminate the operation of said oscillator means when the output power of said ballast passes said threshold level.

* * * * *